US007210744B2

(12) United States Patent
Montgomery, Jr.

(10) Patent No.: US 7,210,744 B2
(45) Date of Patent: May 1, 2007

(54) MANUALLY REPLACEABLE PROTECTIVE WEAR SLEEVE

(75) Inventor: Robert H. Montgomery, Jr., Everett, PA (US)

(73) Assignee: Kennametal Inc., Latrobe, PA (US)

( * ) Notice: Subject to any disclaimer, the term of this patent is extended or adjusted under 35 U.S.C. 154(b) by 577 days.

(21) Appl. No.: 10/657,397

(22) Filed: Sep. 8, 2003

(65) Prior Publication Data

US 2004/0051370 A1 Mar. 18, 2004

Related U.S. Application Data

(62) Division of application No. 09/742,715, filed on Dec. 20, 2000, now Pat. No. 6,854,810.

(51) Int. Cl.
*E21C 35/197* (2006.01)

(52) U.S. Cl. ..... 299/104

(58) Field of Classification Search ..... 299/102–107, 299/110–111

See application file for complete search history.

(56) References Cited

U.S. PATENT DOCUMENTS

| | | | | |
|---|---|---|---|---|
| 3,397,012 A | | 8/1968 | Krekeler | 299/86 |
| RE28,310 E | | 1/1975 | Krekeler | 299/102 |
| 3,865,437 A | | 2/1975 | Crosby | 299/107 |
| 4,084,856 A | | 4/1978 | Emmerich et al. | 299/86 |
| 4,343,516 A | | 8/1982 | Aden | 299/106 |
| 4,491,429 A | * | 1/1985 | Matoba et al. | 384/221 |
| 4,542,943 A | | 9/1985 | Montgomery, Jr. | 299/93 |
| 4,561,698 A | * | 12/1985 | Beebe | 299/104 |
| 4,621,871 A | | 11/1986 | Salani | 299/107 |
| 4,844,550 A | * | 7/1989 | Beebe | 299/107 |
| 4,921,310 A | * | 5/1990 | Hedlund et al. | 299/107 |

(Continued)

FOREIGN PATENT DOCUMENTS

| | | |
|---|---|---|
| DE | 4202961 | 8/1993 |

OTHER PUBLICATIONS

Kennametal Inc., The Mining Tool Authority™ Cutting and Drilling Systems . . . For Underground and Surface Mining Catalog (2000).

(Continued)

*Primary Examiner*—Sunil Singh
(74) *Attorney, Agent, or Firm*—Matthew W. Smith

(57) ABSTRACT

The wear sleeve in the present invention comprises a rearward split ring portion and an intermediate cylindrical ring portion adjacent a forward shoulder portion. The outer diameter of the wear sleeve intermediate portion and rearward split ring portion is uniform. The wear sleeve is inserted into the bit holder's stepped bore aperture. The split ring portion is radially compressed by the smaller diameter opposite portion end as the sleeve is hammered and axially displaced into the bit holder. The split ring portion forms frictional contact with the opposite end portion of the aperture. The wear sleeve friction fit can be easily removed manually in the field. The bit holder and cooperating support block are designed to limit the amount of relative yaw between the two members during operation to reduce the overall wear there between. The invention includes a groove having side surfaces that are inclined at least 15 degrees with respect to the horizontal axis and the cutting bit is positioned more apt toward the central axis of the support block than prior art designs.

4 Claims, 4 Drawing Sheets

U.S. PATENT DOCUMENTS

| | | | | |
|---|---|---|---|---|
| 5,067,775 | A | 11/1991 | D'Angelo | 299/86 |
| 5,088,797 | A | 2/1992 | O'Neill | 299/91 |
| 5,125,720 | A | 6/1992 | Salani | 299/107 |
| 5,273,343 | A | 12/1993 | Ojanen | 299/10 |
| 5,302,005 | A | 4/1994 | O'Neill | 299/91 |
| 5,303,984 | A | 4/1994 | Ojanen | 299/86 |
| 5,392,870 | A * | 2/1995 | Clapham et al. | 299/81.1 |
| 5,628,549 | A | 5/1997 | Ritchey et al. | 299/104 |
| 5,647,641 | A | 7/1997 | Sulosky et al. | 299/106 X |
| 5,683,143 | A * | 11/1997 | Peterson et al. | 299/41.1 |
| 5,725,283 | A | 3/1998 | O'Neill | 299/104 |
| 6,371,567 | B1 | 4/2002 | Sollami | 299/104 |

OTHER PUBLICATIONS

"Quick Change System" publication, The Sollami Company, publication date Sep. 19, 2000, 12 pages.

* cited by examiner

MANUALLY REPLACEABLE PROTECTIVE WEAR SLEEVE

This application is a division of U.S. application Ser. No. 09/742,715, filed Dec. 20, 2000 now U.S. Pat. No. 6,854, 810.

FIELD OF THE INVENTION

The invention relates to a readily replaceable protective wear sleeve for a bit holder.

BACKGROUND OF THE INVENTION

The present invention relates to mining and construction cutting bits and holders, the holders being attached to a rotating cutting drum. The holder includes a replaceable wear sleeve that receives the cutting bit tool.

Cutting tools are subjected to large torques and loads. The cutting bits generally need to be replaced daily. Since the cutting tools require routine maintenance there is a preference and need in the industry to construct a cutting tool assembly that is easily and quickly replaceable in the field.

The holders are often designed to permit the cutting tool to rotate to avoid uneven wear of the bit tool holder and cutting bit. This rotation of the bit causes the holding surface of the bit holder to wear at an accelerated rate. The bit holders become unusable after they wear causing the cutting bit to stop rotating or to fall out of the bit holder. The bit holders take a significant amount of time to replace, typically either by blow torching off the old bit holder and welding a new bit holder onto a rotatable drum, or by mechanically removing the old bit holder mechanically fixing on a new bit holder.

To extend the life of bit holders in the prior art a replaceable wear sleeve is inserted into the bit holder. The sleeve limits the internal wear to which the bit holder is subjected by the cutting bit tool. Eventually these wear sleeves fail and must also be replaced. Prior art wear sleeves are provided with an upstream shoulder that surrounds the aperture of the bit holder to resist the axial forces and loads that would otherwise be directly absorbed by the exposed top face of the bit holder during operation of the cutting tool to prevent wear of the bit holder. Nonrotating wear sleeves tend to wear unevenly on upstream shoulder of the protective sleeve.

In U.S. Pat. No. 5,088,797 to O'Neill, a replaceable wear sleeve for bit holders is disclosed. The wear sleeve is fixed to the tool holder by interference fit. The interference fit is designed so as to permit the sleeve to be removable in the field. Such interference fit designs require precise manufacturing tools for cutting out the outside diameter of the wear sleeve and precision honing equipment for constructing the sleeve holder bore in the bit holder. The holding and cutting equipment for such precision is costly and the manufacturing steps time consuming. Slight deviations in the outside diameter of the sleeve and diameter of the bit holder bore affects the amount of interference and results in large variations in the amount of manual force necessary to remove the wear sleeve from the bit holder.

In the prior art designs such as in U.S. Pat. No. 4,542,943 wear occurs between a replaceable bit holder and a support block that is welded onto a drum. The contacting joint surfaces between the bit holder and support block in this prior art wears during the lifetime of the assembly on account of a yaw movement imposed upon the pick tool assembly during cutting operations. In some less friendly environments silica accumulates between the bit holder and support block and the wear rate between the bit holder and support block significantly increases. This continual wear between the holder and support block also requires that operators constantly tighten the fastening bolt to adequately secure the bit holder to the support block, preventing undesirable catastrophic failure caused by rocking and fretting as the bolt becomes loosened. In some severe environments the wear between the blocks and bit holders becomes so great that the support block and bit holder have to be serviced as frequently as on a monthly basis.

In Montgomery U.S. Pat. No. 4,542,943 the T-shaped shank that fits into the support block groove includes a preferential failing groove situated along the peripheral surface of the shank. Cutting tools are employed in constructing this peripheral groove about the shank. This groove is costly and time consuming to manufacture.

Applicant has invented a non-rotatable wear sleeve that will significantly reduce wear of the bit holder but can still be removed manually while the mining equipment is at its field location.

SUMMARY OF THE INVENTION

The applicant's invention is a wear sleeve for a mining bit holder that attaches to a mining drum. The mining bit holder includes an aperture, which is adapted to receive a wear sleeve. The aperture is a stepped bore with the end portion adjacent the cutting tool having a larger diameter than the bore's opposite rearward end.

The wear sleeve in the present invention comprises a rearward split portion and an intermediate cylindrical portion and a forward shoulder portion. The outer diameters of the wear sleeve intermediate portion and rearward split ring portion are uniform.

The wear sleeve is inserted into the bit holder's stepped bore aperture. The split ring portion is radially compressed by the smaller diameter rearward end as the sleeve is hammered into the bit holder. The split ring portion forms frictional contact with the opposite end portion of the aperture. This wear sleeve friction fit can be easily removed manually in the field.

Applicant's wear sleeve has a collar that is thicker than those collars used in the prior art to improve the wear resistance of the sleeve collar portion that faces the mined materials thereby extending the life of the wear sleeve. The thicker collar improves the tool life of the wear sleeve in comparison to prior art wear washers.

The present invention is less expensive to construct than the prior art as it requires less manufacturing cutting steps than prior art wear sleeves, does not require a threading operation, additional parts or additional assembly steps.

The present invention provides for a wear sleeve that can be manually removed and replaced at field locations.

Another objective of the invention is to design bit holders that have a preferential failing means that can be more quickly and less expensively manufactured than in the prior art.

The applicant's bit holder and support block are designed to reduce undesirable yaw and the wear caused by bit holder yaw movement.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

The following description is for purposes of illustrating the embodiments of the invention only and not for purposes of limiting the scope of the invention.

Figure 1:
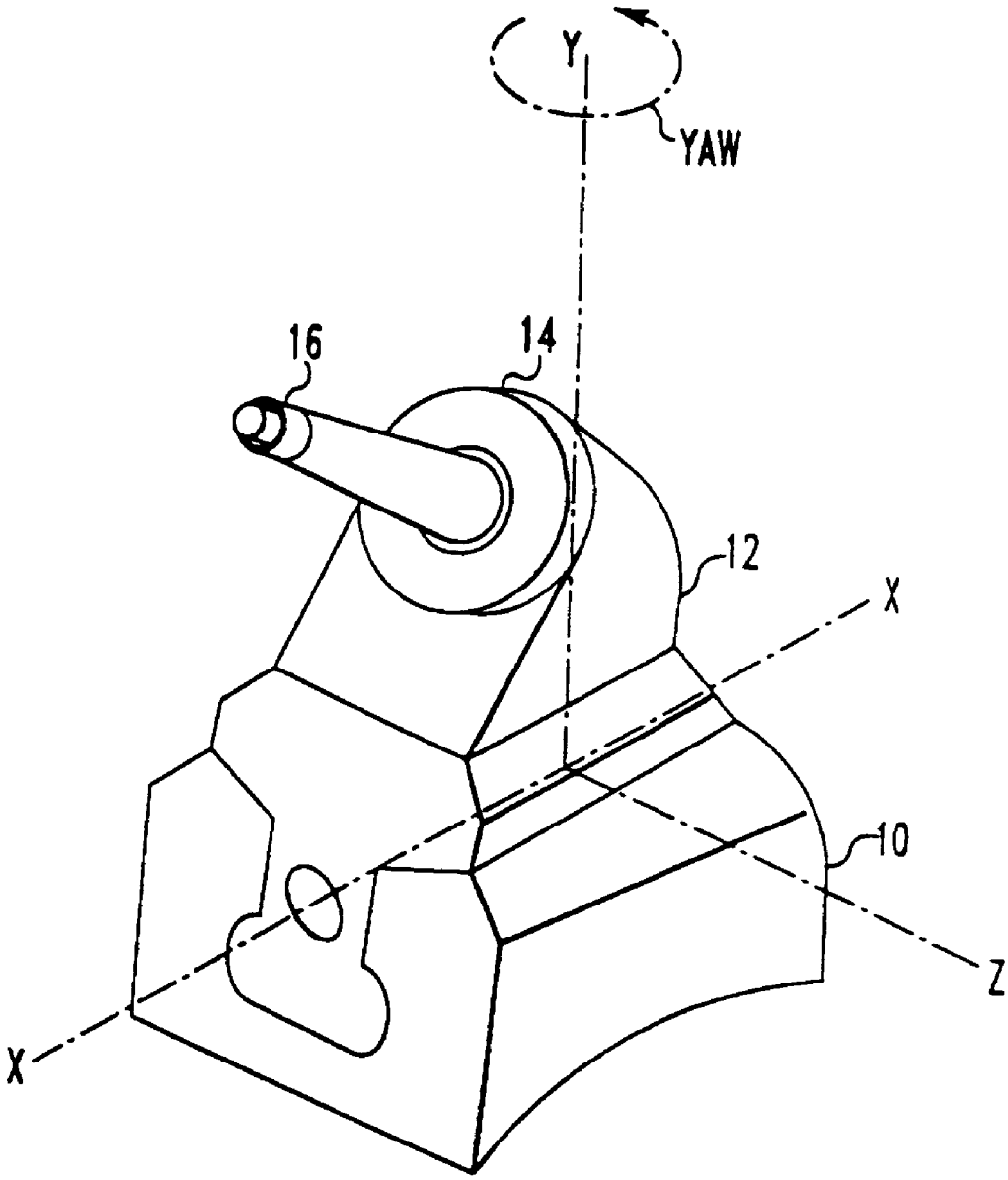
FIG. 1 is a perspective view of a First embodiment of the cutting tool assembly of the present invention.

FIG. 1 depicts the cutting tool assembly for the cutting drum of a mining machine. The cutting tool assembly in FIG. 1 shows a cutting tool 16, a wear sleeve 14, a bit holder 12 and a support block 10. The cutting tool assembly is connected to the rotating drum by methods well known in the art such as welding.

Figure 2:
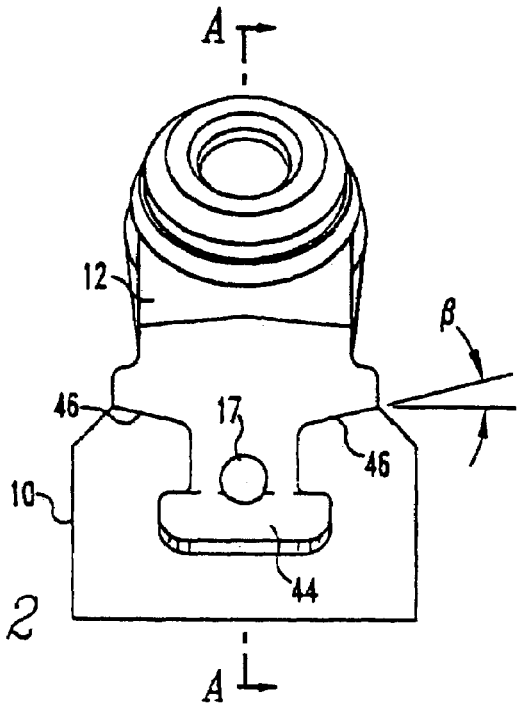
FIG. 2 is a front view of the embodiment shown in FIG. 1.
Figure 2A:
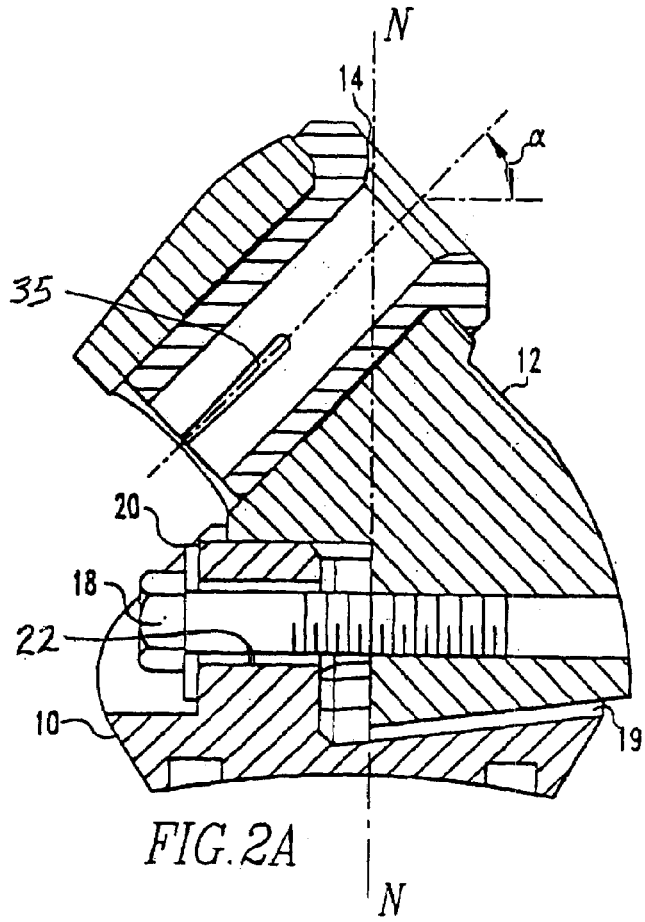
FIG. 2*a* is a cross sectional side view along lines A—A in FIG. 2.

FIG. 2*a* discloses in more detail the wear sleeve 14, the bit holder 12 and the support block 10. The bit holder 12 is connected to the support block 10 by a bolt 18. The support block has a bore 22 for receiving the bolt 18. A washer 20 is placed on the bolt head prior to inserting the bolt into a bore 22. The bolt is threaded into a threaded portion of the bore in the bit holder. The bolt is then tightened to wedge the bit holder into position on the support block.

Figure 3:
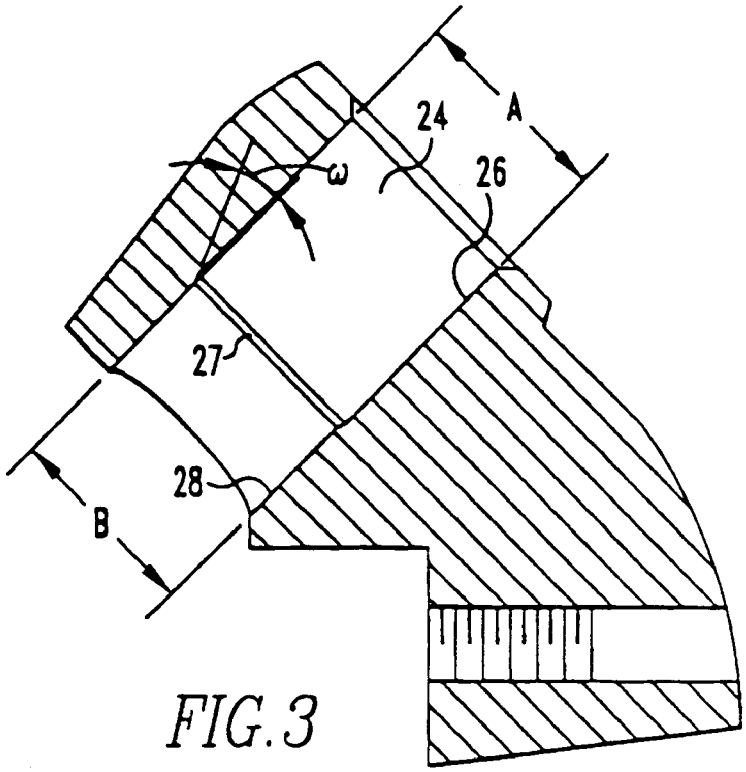
FIG. 3 is a cross-sectional view of the bit holder.

The wear sleeve is shown positioned in the bit holder in FIG. 2. The wear sleeve is friction fit in the bit holder bore. The wear sleeve can be manually hammered into the bit holder bore by a miner or construction worker in the field. In FIG. 3 the bit holder illustrates an aperture 24. The aperture is stepped, having a forward end portion adjacent the cutting tools the forward end portion 26 has a larger diameter than the opposite end portion 28. Transition section 27 between the large bore and small bore is tapered at an angle w with respect to the central axis of the bore 24. The angle w is between 10–30 degrees so that when the sleeve is axially hammered into the bit holder the taper helps to guide and wedge the split ring portion its fixed position.

The wear sleeve 14 is friction fit into the stepped bore. The wear sleeve initially has a central bore of uniform diameter, a split ring portion 30, an intermediate cylindrical portion 32 and a shoulder portion 34. The intermediate portion and split ring portions outer diameters are uniform. The wear sleeve is inserted into the bit holder's stepped bore aperture by the use of a hammer. The split ring portion 30 is radially compressed by the smaller diameter opposite end portion 30 as the sleeve is hammered into position in the bit holder. The split ring portion forms adequate frictional contact with the opposite end portion of the aperture. The wear sleeve friction fit can be easily removed manually in the field.

The shoulder portion 34 helps to protect the bit holder from axial forces applied by the tool bit onto the tool bit holder. The axial loads and torques that occur during operation of the mining drum are transferred to the bit holder through the wear sleeve collar 34.

In one example of this embodiment, the forward end portion of the step bore diameter (A) is 1.185" and the opposite end portion of the step bore 28 diameter (B) is 1.166". The outside diameter (C) of the wear sleeve is 1.181" and has an inner diameter of 0.783". The split ring portion of the wear sleeve upon insertion into the bit holder bore is radially compressed and squeezed into position. The slot 35 is approximately 0.12" inches in width to enable the split ring portion to be squeezed into the smaller diameter portion 28 of the step bore. The split spring portion is made from a spring like resilient material that upon insertion into the stepped bore becomes biased and exerts a radial force component against the bore surface. The wear sleeve can be constructed from 4140 Steel. A resultant axial frictional force component exists between the cooperating contact surfaces of the split ring wear sleeve and smaller diameter portion gf the stepped bore. This frictional fit holds the wear sleeve in position against axial pulling forces on the cutting tool.

The shoulder 34 of the wear sleeve protects the opening of the aperture in the bit holder from axial loads and forces applied to the cutting tool during mining or construction. The thickness of the shoulder 34 in the axial direction is approximately 0.37". This dimension is substantially greater than the shoulder thickness of wear sleeves and washers currently used in industry. The added thickness in the shoulder extends the life of the wear sleeve beyond conventional wear sleeves currently employed in the industry.

Figure 4:
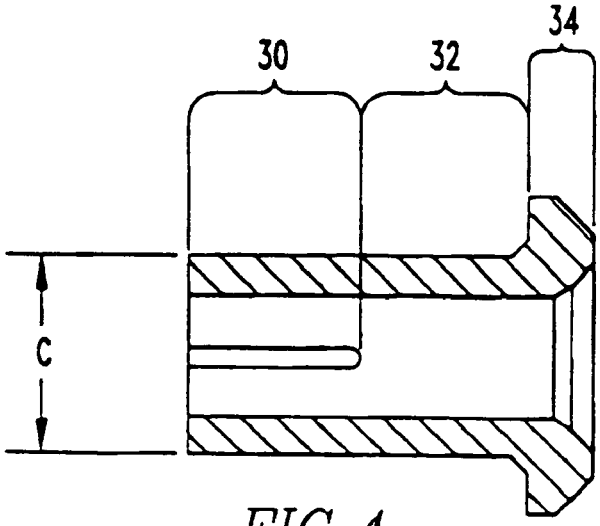
FIG. 4 is a cross-sectional view of the wear sleeve.
Figure 5:
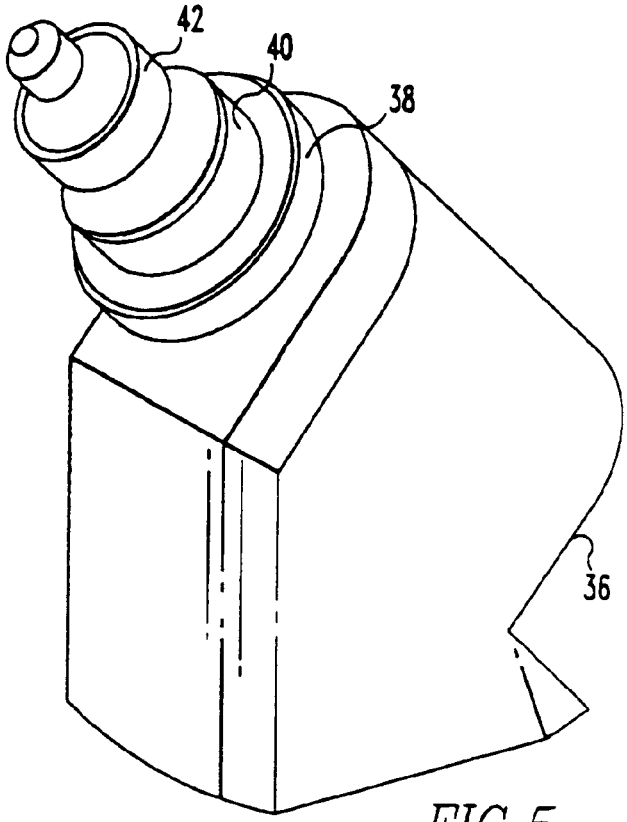
FIG. 5 is a perspective view of a second embodiment of a cutting tool assembly.
Figure 6:
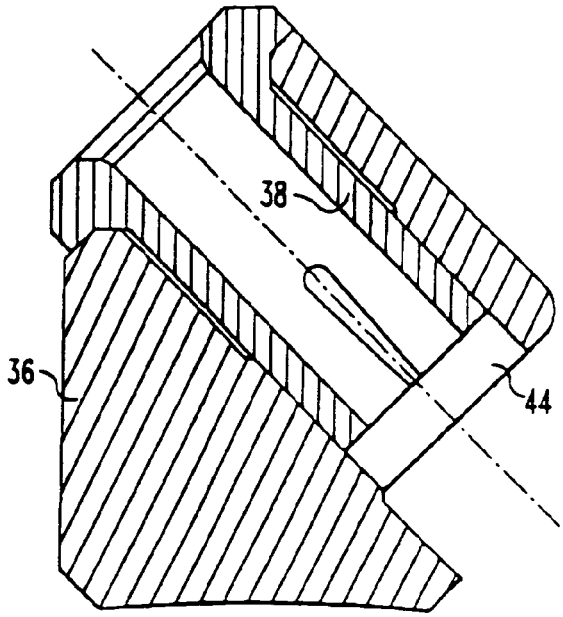
FIG. 6 is a cross section of the second embodiment shown in FIG. 5.

FIGS. 5 and 6 illustrate a second embodiment of the present invention. The second embodiment shows a standard well-known bit holder 36 for mounting the cutting tool. A wear sleeve 38 similar to the wear sleeve disclosed in the first embodiment and shown in FIG. 4 is inserted into a stepped bore aperture 44 similar in construction to the step bore illustrated in FIG. 3. The split ring design frictionally fixes the wear sleeve in position inside the bit holder aperture.

The shoulder of the wear sleeve in the second embodiment is also greater in thickness than prior art shoulders. Similar to the first embodiment the thick collar design extends the useful life of the wear sleeve.

Yaw as shown in FIG. 1 is rotation about the central vertical axis of the support block, see the Y-axis. Rotation about the Y-axis occurs in the horizontal X-Z plane. Forces are applied to the cutting tool tip 16 during rotation of the pick into the earth's strata. The resultant forces applied to the cutting pick during operation are transferred to the drum through the bit holder and support block. The forces on the tip are not all applied along the central axis of the cutting tool. Due to the shape of the tip and the irregular shapes of the earth strata in addition to the axial tool load radial forces are applied to the tool. The radial force components applied to the cutting tool in addition to the force that causes rocking, cause yaw and rolling of the cutting tool. The amount of yaw and rolling that occurs is dependent on the torque applied about the Y-axis and X-axis respectively. The torque is dependent on the radial force component vector on the cutting tool and the length of the moment arm.

FIG. 2 shows the front view of the first embodiment in which the support block groove 19 and T-shaped Key 44 are illustrated. The bit holder 12 rests on top of the support block on symmetric top surfaces 46 adjacent to the centrally located groove 19. The top surfaces 46 of the support block are oriented at an angle (beta) with respect to the horizontal.

In the prior art these surfaces are angled at approximately 10 degrees to the horizontal. The present design includes an angle of at least 15 degrees. The bit holder has a surface that, forms a complimentary angle with the top surface of the support block so that the bit holder makes uninterrupted contact with surface 46. This angle of inclination prevents back and forth movement along Z-axis. This inhibition of movement of the bit holder away from the X-axis accordingly limits rotation about the Y axis. This reduction in yaw about the Y axis reduces the amount of wear between the bit holder and support block.

In addition to the angle of inclination of the top faces 46 of the support block and correspond bit holder surfaces. The bit holder bore 24 is positioned more aft from the central axis N—N as seen in FIG. 2*a* than prior art bit holder bores. The bit holder bore location results in the cutting tool 16 tip location being positioned more towards the aft and closer to the central axis N—N. The closer that the extreme tip of the cutting tool is to the support block central axis N—N the shorter the effective moment arm about the central axis. Hence the torques applied to the bit holder are limited and hence the resulting wear caused by movement of the bit holder against the support block is reduced. In combination the further aft location of the cutting tool and the angled top faces of the support block substantially reduce the torque applied to the cutting tool and the resulting yaw. The reduced yaw of the bit holder results in extended life of the bit holder and support block.

In FIG. 2*a* a bore hole 17 is illustrated that traverses the length of the bit holder shank from an opening on the front face to an opening on the rearward face. The portion of the bore adjacent to the rearward face is threaded for receiving bolt 18. The forward portion of the bore is for the purpose of preferentially weakening the block by reducing the cross sectional area along a plane of the bit holder. When abnormally high loads are applied to the cutting tool bit holders the bit holder will break along this preferentially weakened portion of the bit holder and prevent the support block from being ripped off the drum.

The preferential failing portion is easily constructed and does not require an additional manufacturing step. The preferential failing means is formed by drilling a bore from the forward end of the bit holder to the rearward end of the bit holder.

What is claimed is:

1. A protective wear sleeve for a bit holder of a cutting tool assembly wherein the bit holder contains a central bore, and the wear sleeve comprises:

an elongate body having an axial forward end and an axial rearward end;

the elongate body having a solid enlarged diameter portion adjacent to the axial forward end thereof and a split portion beginning at and extending in an axial forward direction from the rearward end wherein the split portion contains a slot so that the split portion is flexible in a radial direction, and a solid intermediate portion being between and contiguous with the enlarged diameter portion and the split portion;

the split portion having an external surface that is uniform over the entire length thereof, and the intermediate portion having an external surface that is uniform wherein the diameter of the external surface of the split portion is equal to the diameter of the surface of the intermediate portion; and when the wear sleeve is in the central bore, the external surface of the split portion is biased in a radial outward direction against the central bore of the bit holder so as to retain the wear sleeve in the central bore of the bit holder.

2. The protective wear sleeve of claim 1 wherein the split portion extends for less than one-half of the axial length of the elongate body.

3. The protective wear sleeve of claim 1 wherein the enlarged diameter portion comprises a collar for protecting the bit holder from axial forces applied to the cutting tool.

4. The protective wear sleeve of claim 1 wherein the elongate body has a generally cylindrical geometry.

* * * * *

US007210744C1

(12) INTER PARTES REEXAMINATION CERTIFICATE (0157th)

United States Patent

Montgomery, Jr.

(10) Number: US 7,210,744 C1

(45) Certificate Issued: May 4, 2010

(54) MANUALLY REPLACEABLE PROTECTIVE WEAR SLEEVE

(75) Inventor: Robert H. Montgomery, Jr., Everett, PA (US)

(73) Assignee: Kennametal, Inc., Latrobe, PA (US)

Reexamination Request:
No. 95/000,357, Mar. 11, 2008

Reexamination Certificate for:

| | |
|---|---|
| Patent No.: | **7,210,744** |
| Issued: | **May 1, 2007** |
| Appl. No.: | **10/657,397** |
| Filed: | **Sep. 8, 2003** |

Related U.S. Application Data

(62) Division of application No. 09/742,715, filed on Dec. 20, 2000, now Pat. No. 6,854,810.

(51) Int. Cl.
*E21C 35/197* (2006.01)

(52) U.S. Cl. ..... 299/104; 175/408

(58) Field of Classification Search ..... None
See application file for complete search history.

(56) References Cited

U.S. PATENT DOCUMENTS 6,585,326 B2 7/2003 Sollami

*Primary Examiner*—Glenn K. Dawson

(57) ABSTRACT

The wear sleeve in the present invention comprises a rearward split ring portion and an intermediate cylindrical ring portion adjacent a forward shoulder portion. The outer diameter of the wear sleeve intermediate portion and rearward split ring portion is uniform. The wear sleeve is inserted into the bit holder's stepped bore aperture. The split ring portion is radically compressed by the smaller diameter opposite portion end as the sleeve is hammered and axially displaced into the bit holder. The split ring portion forms frictional contact with the opposite end portion of the aperture. The wear sleeve friction fit can be easily removed manually in the field. The bit holder and cooperating support block are designed to limit the amount of relative yaw between the two members during operation to reduce the overall wear there between. The invention includes a groove having side surfaces that are inclined at least 15 degrees with respect to the horizontal axis and the cutting bit is positioned more apt toward the central axis of the support block than prior art designs.

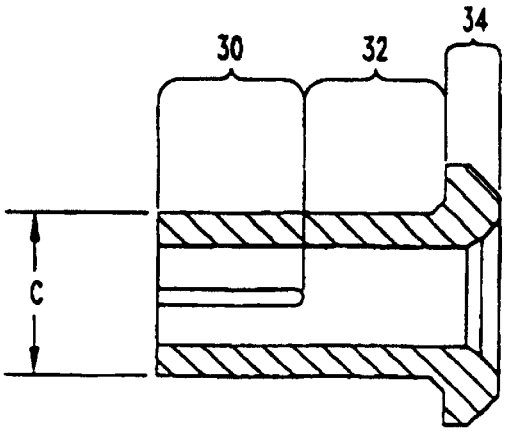

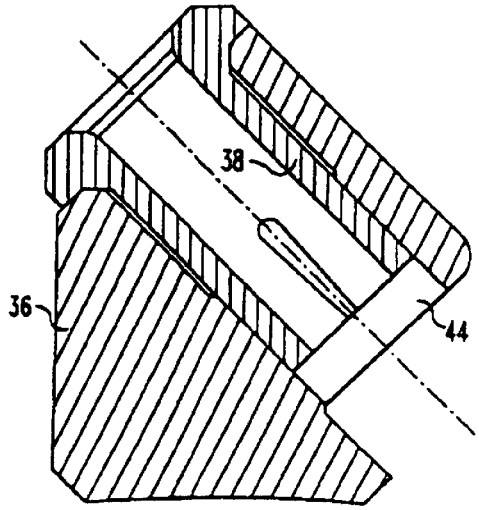

INTER PARTES REEXAMINATION CERTIFICATE ISSUED UNDER 35 U.S.C. 316

NO AMENDMENTS HAVE BEEN MADE TO THE PATENT

AS A RESULT OF REEXAMINATION, IT HAS BEEN DETERMINED THAT:

The patentability of claims 1–4 is confirmed.

* * * * *